US005595040A

United States Patent [19]

Chen

[11] Patent Number: 5,595,040

[45] Date of Patent: Jan. 21, 1997

[54] BEAM-TO-COLUMN CONNECTION

[75] Inventor: Sheng-Jin Chen, Taipei, Taiwan

[73] Assignee: National Science Council, Taipei, Taiwan

[21] Appl. No.: 278,034

[22] Filed: Jul. 20, 1994

[51] Int. Cl.[6] ..... E04H 9/02; E04C 3/00

[52] U.S. Cl. ..... 52/729.1; 52/167.1; 52/731.1; 52/736.2; 52/737.2

[58] Field of Search ..... 52/729, 721, 731.1, 52/167.1, 167.3, 729.1, 729.2, 729.3, 729.4, 729.5, 726.1, 726.2, 736.2, 737.2, 740.8

[56] References Cited

U.S. PATENT DOCUMENTS

| | | | |
|---|---|---|---|
| 1,725,439 | 8/1929 | Carns | 52/729 |
| 3,716,959 | 2/1973 | Bernardi | 52/721 |
| 5,148,642 | 9/1992 | Plumier et al. | 52/729 X |
| 5,163,256 | 11/1992 | Fukumoto et al. | 52/167.1 |
| 5,349,749 | 9/1994 | Taga | 52/167.1 |

FOREIGN PATENT DOCUMENTS

| | | | |
|---|---|---|---|
| 4-169665 | 6/1992 | Japan | 52/167.1 |
| 5-156841 | 6/1993 | Japan | 52/167.1 |

OTHER PUBLICATIONS

Chen, Sheng-Jin, and Lin, Hsin-Yi, *Stress Concentration and Fracture of Steel Beam-To-Column Moment Connection,* The Chinese Journal of Mechanics, vol. 6, No. 2, Dec. 1990. Published in Taipei, Taiwan. Full length manuscript submitted in Chinese and an English translation of the abstract. pp. 3, 4.

Chen, Sheng-Jin and Chen, Gwang-Kai, *Fracture of Steel Beam To Box Column Connections,* Journal of the Chinese Institute of Engineers, vol. 16, No. 3, pp. 381-394 (1993). Published in taipei, Taiwan. Full length manuscript submitted in English.

Popov, Egor P., Amin, navin R., Louie, Jason J. C. and Stephen, Roy M., *Cyclic Behavior of Large Beam-Column Assemblies,* Earthquake Spectra, a professional journal of the Earthquake Engineering Research Institute, vol. 1:2, pp. 9-23 (1985).

Engelhardt, M. D. and Husain, A. S., *Cyclic-Loading Performance of Welded Flange-Bolted Web Connections,* Journal of Structural Engineering, vol. 119, No. 12, pp., 3537-3550 (Dec. 1993).

*Primary Examiner*—Wynn E. Wood
*Assistant Examiner*—Laura A. Saladino
*Attorney, Agent, or Firm*—Curtis, Morris & Safford, P.C.

[57] ABSTRACT

A beam-to-column connection is suitable for connecting an H-beam to a column surface. The connection is defined at an end of the H-beam which has a web plate and a pair of flange plates. The connection comprises a web plate member integrally formed with the web plate of the H-beam; and a pair of flange plate members, each of which is integrally formed with the flange plates and has a tapered zone.

8 Claims, 9 Drawing Sheets

BEAM-TO-COLUMN CONNECTION

BACKGROUND OF THE INVENTION

1. Field of the Invention

The present invention relates to a beam-to-column connection, especially to a beam-to-column connection having high ductility.

2. Description of Prior Art

In the seismic resistant design of a building structure, the structural system and members should have enough strength to resist the forces generated during an earthquake. In order to prevent catastrophic collapse of the structure during a severe earthquake, stable and reliable energy dissipation capacity should be provided through proper design and detailing of the system, members and joints. For steel moment resisting frames under severe earthquake forces, it is usually assumed that the input energy is absorbed and dissipated primarily by the plastic hinge formed at the beam-to-column connection. The rotational capacities of beam-to-column connection greatly affect the energy dissipation capacity of moment resisting frames.

In structural analysis or design, emphasis is usually placed on either the individual structural member or the global behavior of the frame. For steel frames, the design and construction of their members is quite straightforward, since most of these members are pre-designed and fabricated structural shapes. Design guidelines have been well established for these structural shapes to fully develop their strength and ductility. However, the design and construction of the connections between these structural members is somewhat complicated. High strength bolts and/or welds are usually utilized in these connections. The structural behavior of these connections is not only affected by the geometric changes around connections but also affected by drilling of bolt holes and welding. Improper design and/or construction of these connections may lead to the collapse failure of the whole structure.

Research on the characteristics of connections is usually conducted through large scale structural testing to account for the effects of bolting and welding. In general engineering practice, the steel beam, such as an H-beam having a pair of parallel flanges connected by a web, is usually connected to the column by bolting the beam web to the shear tab on the column plate and then welding the beam flange with the column plate to form a moment connection. This is widely used and has almost become standard practice. However, from large scale experimental studies, lack of deformation capacity of this type of connection was reported by S. J. Chen (The Chinese Journal of Mechanics, Vol. 6 No. 2, 1990), S. J. Chen (Journal of the Chinese Institute of Engineers, Vol. 16, No. 3, pp. 381–394, 1993).

The ductility (i.e. the deformation capacity or the energy dissipation capacity) of a connection can be represented by plastic rotational angle $\Theta p$. In order to define the plastic rotational angle $\Theta p$, a cantilever beam is chosen for illustration as shown in FIG. 1. A cantilever beam supporting a concentrated load P at its free end is constructed of a elastic-plastic material. It is customary that a downward load is a positive load and an upward load is a negative load. In FIG. 1, the load is a positive load. Assuming the cantilever beam has a total deflection $\delta$ and elastic deflection $\delta e$, then the plastic deflection of the cantilever beam $\delta p$ is equal to $\delta-\delta e$. Also, assuming the length of the cantilever beam is L, the plastic rotational angle $\Theta p$ is defined as following:

$$\Theta p=\mathrm{Min}[\mathrm{Abs}(\Theta p')]$$

wherein $\Theta p'=\delta p/L$. From the abovementioned definition, it is understood that the larger plastic rotational angle a beam has, the larger ductility a connection of the beam has. FIG. 2 shows statistical data for 37 large size steel beam to box-column connections subjected to cyclic load tests in recent years in Taiwan. Out of these 37 specimens, about 20% (8 specimens) were brittle. The average plastic rotational angle of these specimens was only 0.92% radian which was not adequate.

Recent work done by Engelhardt (J. of Structural Division, ASCE, vol. 119, No. 12, 1993) also found lack of reliable deformation capacity of the beam to H-column moment connection. The reliability of field welding has long been questioned. Some people prefer to weld a short beam to the column in the factory and use all-bolt beam splices in the field. However, this would increase the construction cost substantially. Cover plates are also selected to increase the flexural strength at beam-to-column connections and to move the critical section away from the field welding. But the use of cover plates usually increases the amount of field welds and in-turn increases the possibility of welding defects.

During the Northridge Earthquake in California in 1994, a number of steel buildings suffered from fractures in welded beam-to-column connections of moment resisting frames. The performance of these steel frames during the earthquake raised questions about the quality assurance of field welding. It seems that the current welding design is susceptible to failure in earthquakes.

SUMMARY OF THE INVENTION

An object of the present invention is to provide a beam-to-column connection which has high ductility and can be utilized in both new structures and existing structures by retrofitting.

In accordance with the object of the present invention, there is provided a beam-to-column connection for connecting an H-beam to a column surface. The connection is defined at an end of the H-beam which has a web plate and a pair of flange plates. The depth of the H-beam is D. The connection comprises a web plate member integrally formed with the web plate of the H-beam; and a pair of flange plate members, each of which is integrally formed with the flange plates and has a tapered zone. The tapered zone is formed within a region which is defined between the column surface and a line parallel to and apart from the column surface at a distance 2D. The width of the flange plate members in the tapered zone is determined by reducing the plastic moment capacity of the H-beam to an amount of 90%~95% of the demand moment capacity of the H-beam.

BRIEF DESCRIPTION OF THE DRAWINGS

The present invention can be more fully understood by reading the subsequent detailed description and examples with references made to accompanying drawings, wherein.

DETAILED DESCRIPTION OF THE PREFERRED EMBODIMENT

In order to understand the following embodiments, relevant principles need to be introduced first.

Figure 3A:
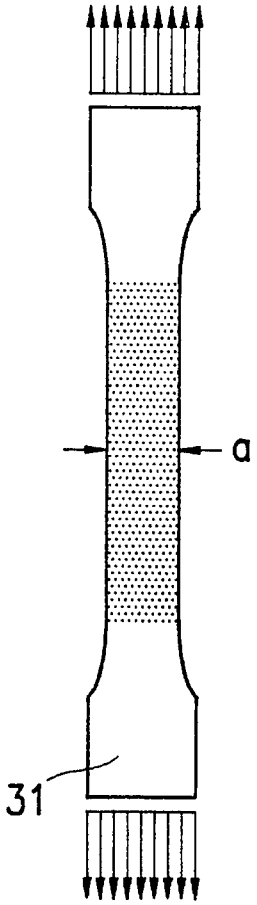
FIG. 3*a*~FIG. 3*c* show three tension coupons under uniform loads at their ends.
Figure 3B:
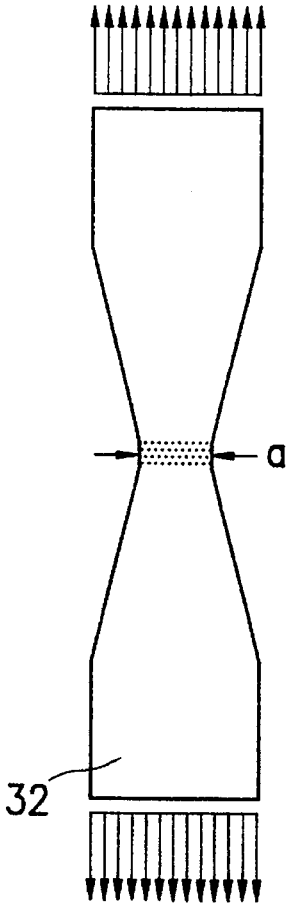
Figure 3C:
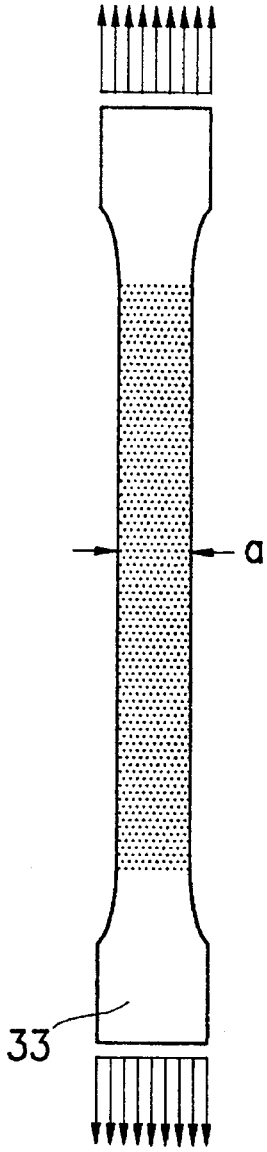

The geometry, loading type and material properties all affect the hysteresis performance of a structural member. FIG. 3*a*~FIG. 3*c* show three tension coupons 31, 32, 33 under uniform loads at their ends. Each of the tension coupons 31, 32, 33 has the same minimum width "a" and is made of the same material. When the loads are gradually increased, the reduced sectional area of the tension coupon 31 will yield uniformly. However, the tension coupon 32 that has varying width along its length will yield around the section of minimum width only. Since the plastic deformations concentrate in a limited area, only very limited energy dissipation capacity can be expected. The deformation characteristics of the tension coupon 32 can be classified as brittle. The tension coupon 33 has the same sectional properties as the tension coupon 31 except it has a longer length of constant stress area. Hence, the tension coupon 33 possesses larger plastic volume and will dissipate larger amount of energy as compare with the tension coupon 31.

Figure 4:
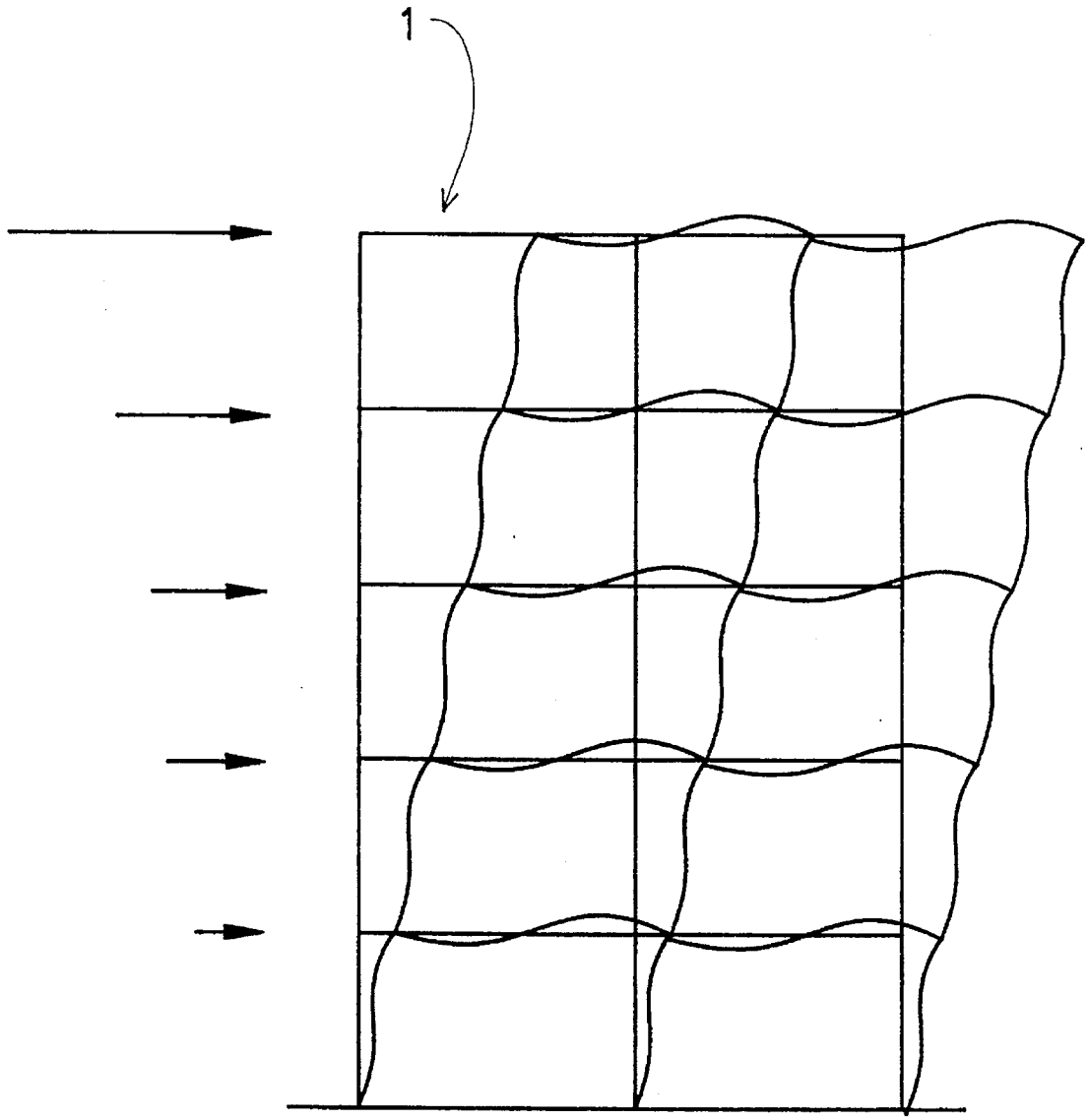
FIG. 4 is a schematic diagram of a typical moment resisting frame under earthquake loads.
Figure 5A:
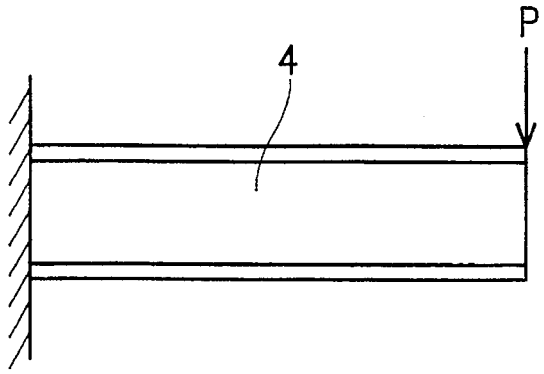
FIG. 5*a* shows a cantilever beam model under a concentrated load at its free end.
Figure 5B:
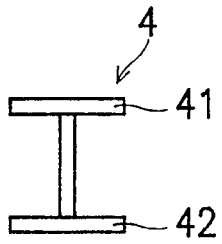
FIG. 5*b* shows a cross section of the cantilever beam model according to FIG. 5*a;*
Figure 5C:
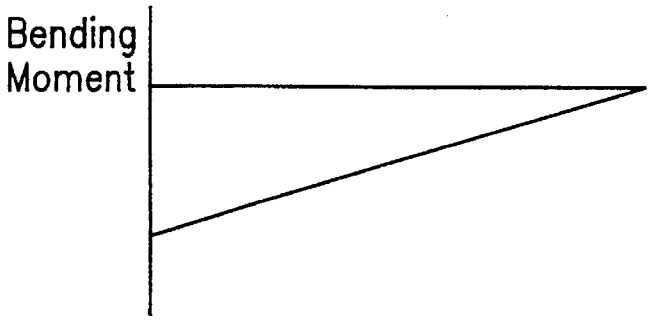
FIG. 5*c* is a bending moment diagram of the cantilever beam model according to FIG. 5*a;*
Figure 5D:
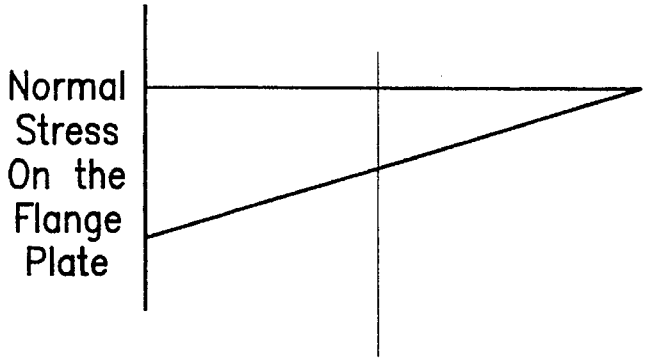
FIG. 5*d* is a normal stress diagram of a flange plate of the cantilever beam model according to FIG. 5*a;*
Figure 6:
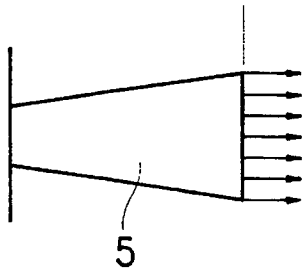
FIG. 6 shows an equivalent flange plate of the flange plate according to FIG. 5*d;*

Referring next to FIG. 4 through FIG. 6, for a typical moment resisting frame 1 under earthquake loads (FIG. 4), it is found that the earthquake loads are primarily resisted by the flexure behavior on the beam-to-column connections. A cantilever beam model 4 under concentrated load P at its free end (FIG. 5*a*) would produce the same moment gradient as the frame.1. The cantilever beam model 4 has a pair of flange plates 41, 42 (FIG. 5*b*) connected by a web. FIG. 5*c* is a bending moment diagram of the cantilever beam model 4. FIG. 5*d* is a normal stress diagram of the flange plate 41 of the cantilever beam model 4. The same stress state can be obtained by modelling the flange plate 41 on a plate 5 (FIG. 6) with varying width and subject to a uniform load at the far end. However, this equivalent plate 5 also simulates the situation of the tension coupon 32 shown in FIG. 3*b*. The tension coupon 32 has little deformation capacity and will readily brittle fracture. This phenomenon explains why the steel beam-to-column connection usually possesses limited ductility.

Figure 7:
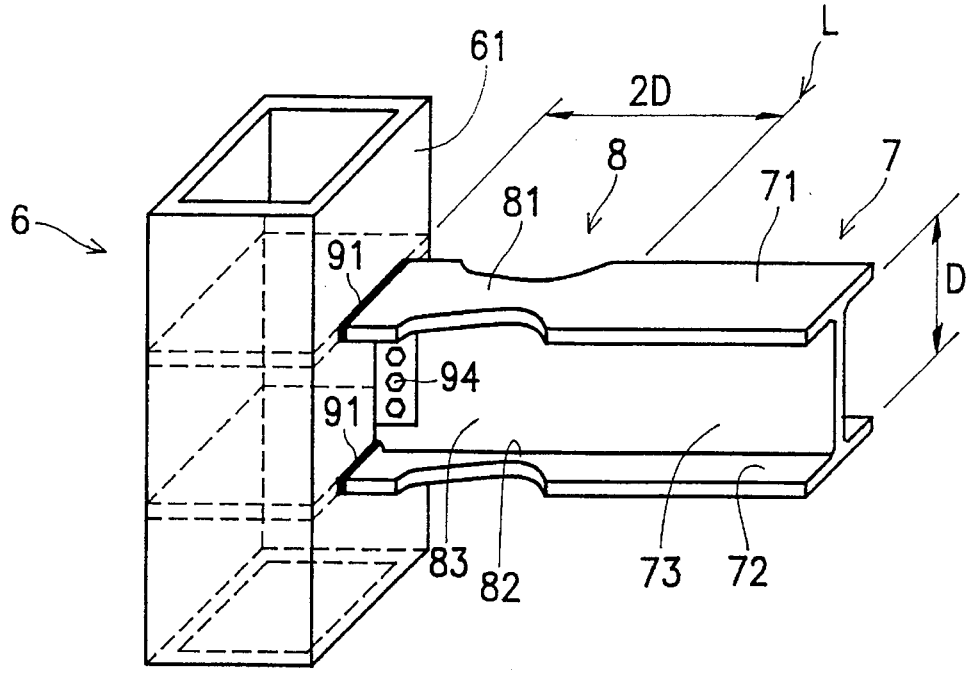
FIG. 7 is a perspective diagram of an H-beam connected to a box-column through a beam-to-column connection according to an embodiment of this invention.

FIG. 7 is a perspective diagram of a H-beam connected to a box-column through a beam-to-column connection according to an embodiment. A numeral 6 represents the box-column and 7 represents the H-beam. The H-beam 7 includes a web plate 73 and a pair of flange plates 71, 72. A cross section of the H-beam is in the shape of an H because the flange plates 71, 72 are formed at the opposite sides of the web plate 73 respectively. The depth of the H-beam is D. The beam-to-column connection 8 is defined at one end of the H-beam 7 and includes a web plate member 83 and a pair of flange plate members 81, 82. In other words, the flange plate members 81, 82 and the web plate member 83 are integrally formed with the flange plates 71, 72 and the web plate 73 respectively. The connection 8 formed at the end of the H-beam 7 can be connected to the box-column 6 by welds 91 and/or bolts 94.

Figure 8:
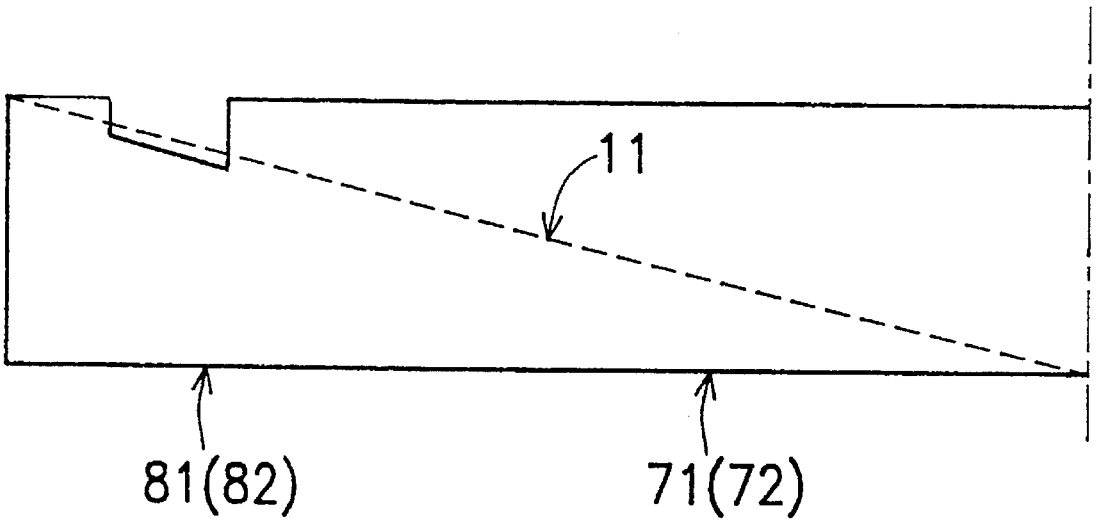
FIG. 8 indicates a demand moment capacity on the flange plate of the H-beam according to FIG. 7.

Each of the flange plate members 81, 82 has a tapered zone. The flange plate members 81, 82 are trimmed to form the tapered zone starting at a short distance from a column surface 61. This arrangement is to avoid welding defects and a deterioration of material properties in the heat effect zone. Generally speaking, the distance where the tapered zone begins from the column surface 61 is between about 5 cm and 12 cm. The end of the tapered zone will depend on the requirements and designs of a structure. By inventor's experiences, however, the connection 8 has good performance under a situation that the tapered zone is formed "within" a region which is defined between the column surface 61 and a line L parallel to and apart from the column surface 61 at about a distance 2D (D is the beam depth). Trimming the flange plate member 81, 82 of the connection 8 out of the mentioned region decreases the required stiffness of the connection 8. The purpose of the tapered zone is to create a finite area of plastic zone. Referring to FIG. 8, a dotted line 11 indicates moment gradient (or demand moment capacity) of the H-beam 7. The tapered zone of the flange plate members 81, 82 are cut according to the moment gradient that would produce an enlarged area of plastic hinge. In this embodiment, the flange plate members 81, 82 of the connection 8 are tapered to reduce the provided strength (the plastic moment capacity) equal to or a little less than the demand moment capacity. To reduce the plastic moment capacity equal to the demand moment capacity means the flange plate members 81, 82 are cut along the dotted line 11. However, to set the plastic moment capacity at the tapered area to be a little less than the demand moment capacity (as shown in FIG. 8) is to ensure that the plasticity will occur in the tapered area, and to avoid the failure occurring at the column face where field welding may have deteriorated the material.

The tapered zone essentially form a uniform stress region in the flange plate members 81, 82 which reduces the plastic moment capacity of the H-beam 7 to about 90% to 95% of the demand moment capacity of the H-beam 7. This renders the connection between the H-beam and the box column less brittle and increases the plastic rotational angle at the connections to about 3.0% to 5.0% radian.

Figure 9:
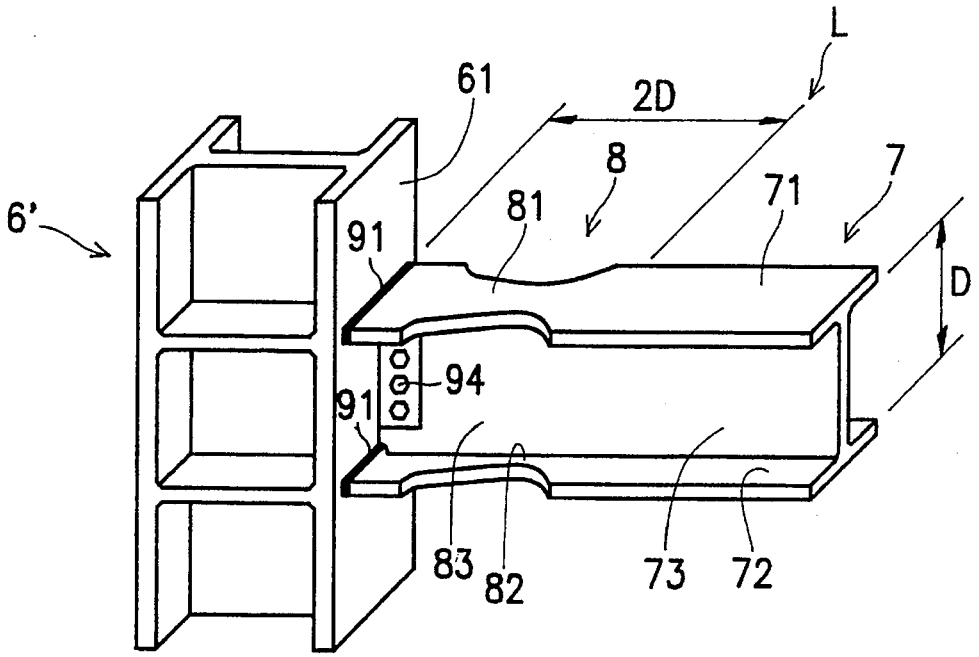
FIG. 9 is a perspective diagram of an H-beam connected to an H-column through a beam-to-column connection according to an alternative embodiment of this invention.

A beam-to-column connection according to this invention is also suitable for connecting an H-beam to an H-column. As shown in FIG. 9, a numeral 6' represents an H-column. A beam-to-column connection 8 is defined at one end of an H-beam 7. By welding and/or bolting, the connection 8 of the H-beam 7 is connected to the H-column 6'. Because the H-beam 7 and the connection 8 are the same as those in FIG. 7, the description of them in detail is omitted here.

The following specific examples are intended to demonstrate this invention more fully without acting as a limitation upon its scope, since numerous modifications and variations will be apparent to those skilled in the art. Please refer to FIG. 10*a* through FIG. 10*c*, each of beam specimens PC1, PC2, PC3 selected is the H600×300×12×20(mm) with A36 steel, wherein 600(mm) represent the beam depth, and is 1850 mm in length. The column 21 selected is the box column of □500×500×20×20(mm) with ASTM A572 Grade 50 steel.

EXAMPLE 1

Specimen PC1

Figure 10A:
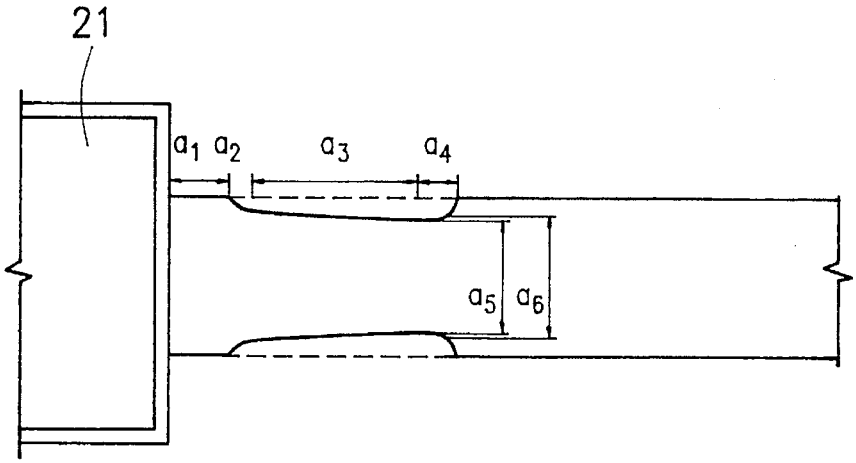
FIG. 10*a* is a schematic diagram of an H-beam connected to a box-column through a beam-to-column connection according to example 1 of this invention.

The detail of the specimen PC1 is shown in FIG. 10*a*, wherein a1=12 cm, a2=5 cm, a3=25 cm, a4=10 cm, a5=19.9 cm, a6=24.7 cm. The flange plate member of the connection is trimmed starting at a distance a1 away from column face. This arrangement is aimed at avoiding the field weld and the weld access hole that is located at the junction of web and flanges. This is followed by a transition area of length a2 and then object area of length a3. After the object area is followed by another transition area of length a4. In this example, the width of the flange plate member in the object area is determined by reducing the plastic moment capacity to 95% of demand moment capacities. The minimum flange width in the object area is a5 and the maximum is a6.

EXAMPLE 2

Specimen PC2

Figure 10B:
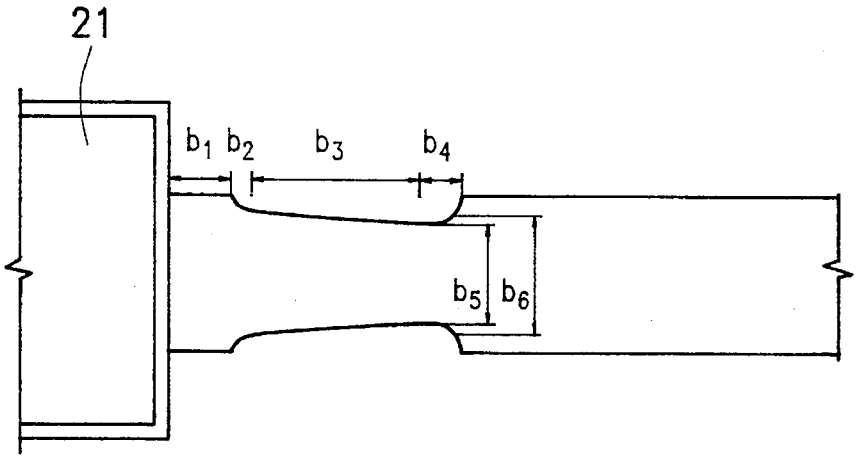
FIG. 10*b* is a schematic diagram of an H-beam connected to a box-column through a beam-to-column connection according to example 2 of this invention.

In FIG. 10*b*, b1=12 cm, b2=5 cm, b3=30, b4=10 cm, b5=17.5 cm, b6=23.0 cm. The specimen PC2 is similar to the specimen PC1. The length of the object area of PC2 is 30 cm, which is slightly larger than that of PC1. This is to increase the energy dissipation capacity. For specimen PC2, the width of the flange plate member in the object area is determined by reducing the plastic moment capacity to 90% of demand moment capacities. The minimum plate width in the object area is b5 and the maximum is b6.

EXAMPLE 3

Specimen PC3

Figure 10C:
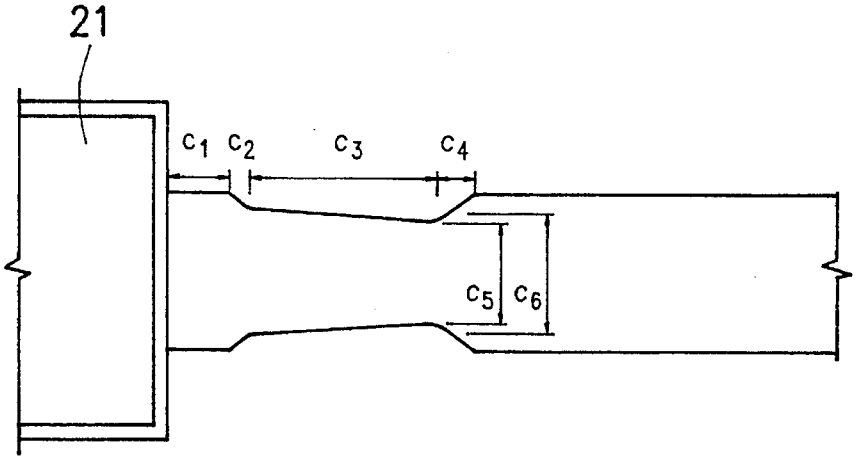
FIG. 10*c* is a schematic diagram of an H-beam connected to a box-column through a beam-to-column connection according to example 3 of this invention.

In FIG. 10*c*, c1=12 cm, c2=5 cm, c3=30 cm, c4=10 cm, c5=17.5 cm, c6=23.0 cm. Instead of smooth curves, the specimen PC3 uses straight lines for the cutting of the flange plate in the transition area. Except this, the specimen PC3 is exactly the same as the specimen PC2.

The specimens PC1, PC2, PC3 are tested under cyclic load with severe load and displacement amplitudes up to their ultimate stages. This is to simulate the recurrence of seismic loading. Each of the specimens PC1, PC2, PC3 is loaded at its free end. The length from loading point to the column surface is equal to the beam length (1850 mm) that is about three times of the beam depth. This would induce a shear force of about 0.6 Vp, Vp is the nominal shear strength of the beam, when the beam reaches its nominal plastic strength. This is to simulate the condition that the beam-to-column connection is subjected to both high shear and high bending moment simultaneously. The ultimate strength is reached when the structure deforms rapidly but the loads remain essentially constant or even decrease.

Figure 1:
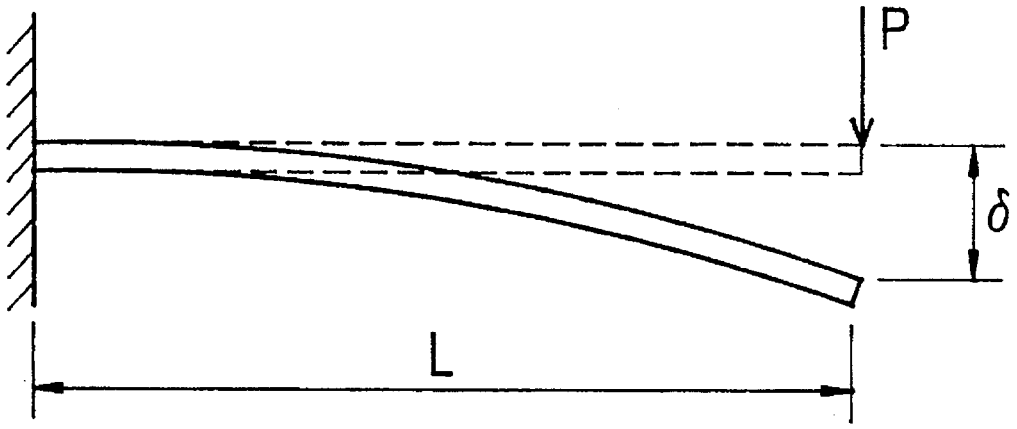
FIG. 1 is a schematic diagram of a cantilever beam under a concentrated load at its free end.
Figure 2:
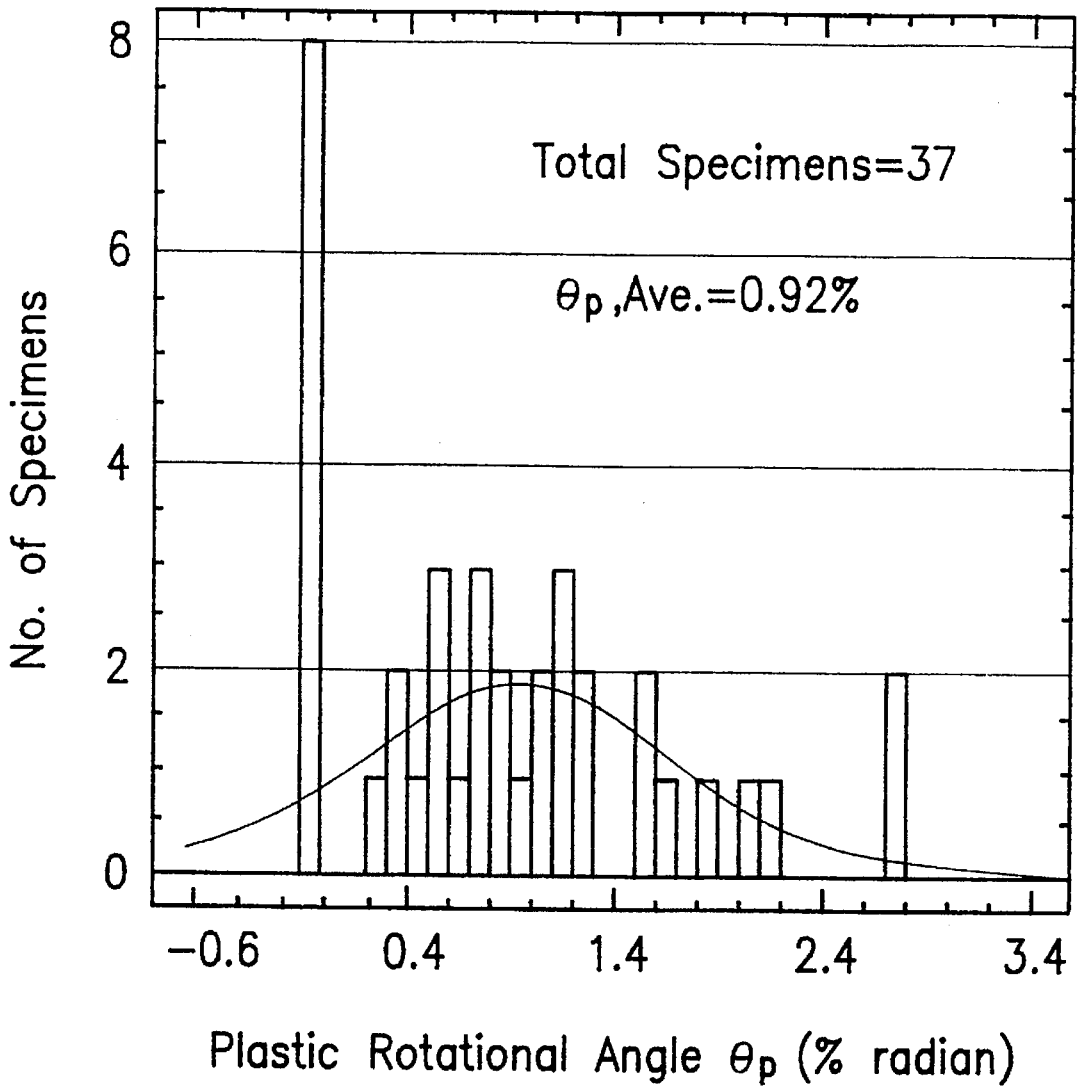
FIG. 2 shows statistic data from 37 large size steel beam to box-column connections subjected to cyclic load tests in Taiwan.
Figure 11:
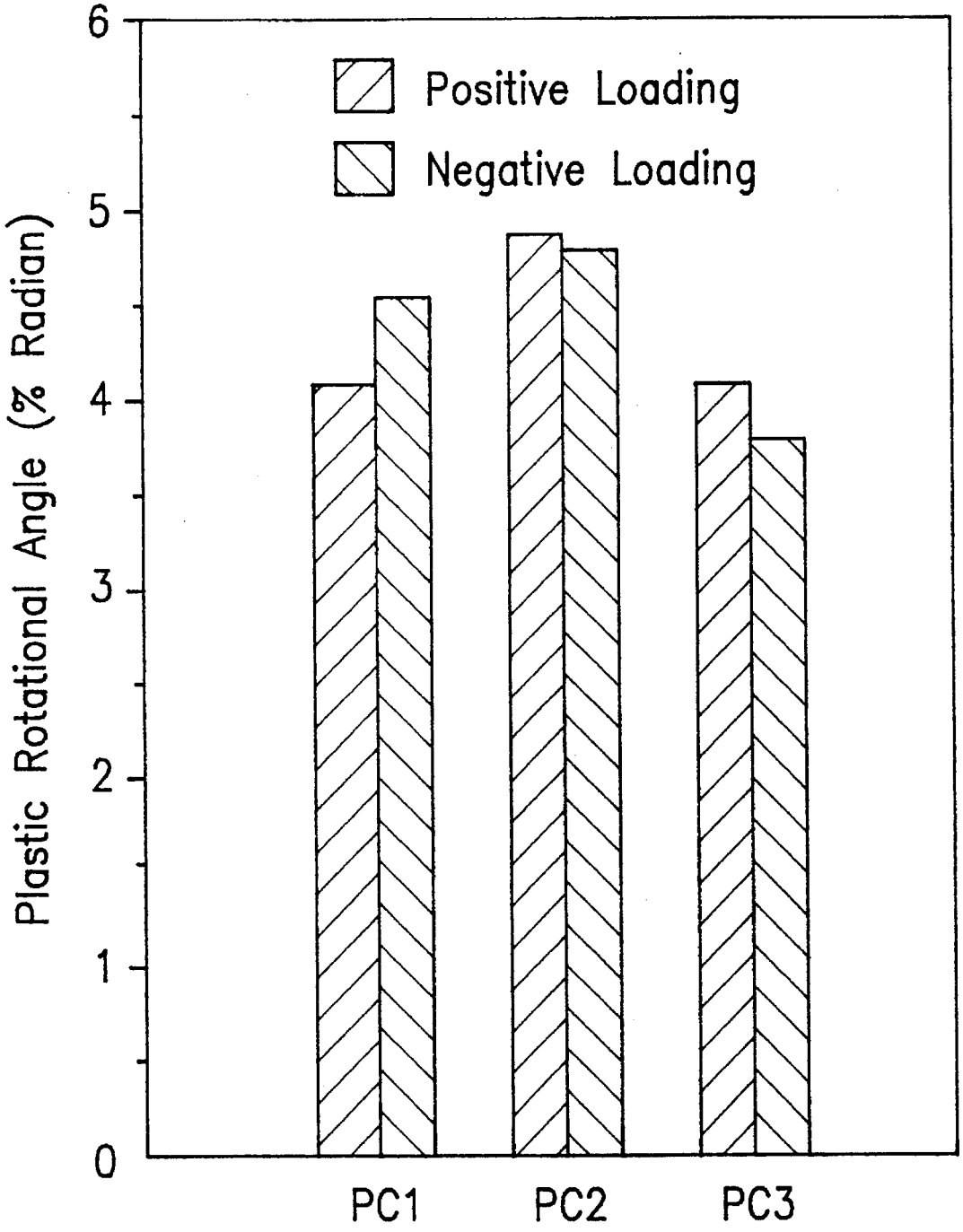
FIG. 11 shows plastic rotational angles of specimens PC1, PC2, PC3 in the example 1~3.

The plastic rotational angles of the specimens YC1, YC2, PC1, PC2, PC3 under the positive loading and the negative loading are shown in FIG. 11. From FIG. 2 the average plastic rotational angle of 37 large size beam-to-column connection tests is only 0.92% radian, which is not adequate to survive a severe earthquake. The plastic rotational angles at the connections of the specimens YC1, YC2, PC1, PC2, PC3 tested are 2.35% to 4.84% radian. These amounts of the plastic rotational angles are several times higher than that of the prior art.

Although this invention has been described in its preferred forms and various examples with a certain degree of particularity, it is understood that the present disclosure of the preferred forms and the various examples can be changed in the details of construction. The scope of the invention should be determined by the appended claims and not by the specific examples given.

What is claimed is:

1. An apparatus for connecting an H-beam, to a column surface, said apparatus comprising:

the H-beam having a pair of flange plates and a web plate positioned between the flange plates, a plastic moment capacity and a demand moment capacity;

a web plate member disposed at an end of the H-beam integrally formed with said web plate of said H-beam; and a pair of flange plate members also disposed at an end of the H-beam respectively integrally formed with said flange plates, each of the flange plate members including means for reducing the plastic moment capacity of said H-beam to an amount of 90%~95% of the demand moment capacity of said H-beam, said reducing means comprising a tapered zone that is non-uniform.

2. The apparatus of claim 1 wherein the tapered zone includes an object area of increasing tapering width in the flange plate members.

3. An H-beam comprising a web plate connected to a pair of flange plates, each of the flange plates having a width, the H-beam having a plastic moment capacity, a demand moment capacity and, at an end of the H-beam, a region having a tapered zone of non-uniform width in the flange plates to reduce the plastic moment capacity of the H-beam to about 90 to 95% of the demand moment capacity of the H-beam.

4. The H-beam as claimed in claim 3, wherein the H-beam includes a connection for a surface, said connection having a plastic rotational angle of about 3.0 to 5.0% radian.

5. The H-beam as claimed in claim 4 wherein the plastic rotational angle is about 3.79 to 4.8% radian.

6. The H-beam as claimed in claim 3 in which the H-beam has a depth D and the tapered zone is formed within a distance 2D from the end of the H-beam.

7. The H-beam as claimed in claim 6 wherein the width of the flange plates decreases in the tapered zone in the direction away from the end of the H-beam.

8. An H-beam having a plastic moment capacity and a demand moment capacity and a tapered zone at an end of the H-beam which is adapted to form a connection to a surface, wherein the tapered zone is non-uniform to provide the plastic moment capacity of the H-beam which is about 90 to 95% of the demand moment capacity of the H-beam.

* * * * *

UNITED STATES PATENT AND TRADEMARK OFFICE

CERTIFICATE OF CORRECTION

PATENT NO. : 5,595,040

DATED : January 21, 1997

INVENTOR(S) : Sheng-Jin Chen

It is certified that error appears in the above-identified patent and that said Letters Patent is hereby corrected as shown below:

Please correct Letters Patent as follows:

Title page, as listed under Other Publications, lines 4 and 5 of hird publication, please delete "pp. 9-23".

Signed and Sealed this

Ninth Day of September, 1997

Bruce Lehman

*Attest:*

BRUCE LEHMAN

*Attesting Officer*

*Commissioner of Patents and Trademarks*